US008497685B2

(12) United States Patent
Sugiura

(10) Patent No.: US 8,497,685 B2
(45) **Date of Patent: *Jul. 30, 2013**

(54) ANGULAR POSITION SENSOR FOR A DOWNHOLE TOOL

(75) Inventor: Junichi Sugiura, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1606 days.

This patent is subject to a terminal disclaimer.

(21) Appl. No.: 11/805,230

(22) Filed: May 22, 2007

(65) Prior Publication Data

US 2008/0294344 A1 Nov. 27, 2008

(51) Int. Cl.
*G01V 3/08* (2006.01)

(52) U.S. Cl.
USPC ..... 324/346; 324/345

(58) Field of Classification Search
USPC ..... 324/333, 338, 345–346, 351, 355–356, 324/366, 369, 207.25; 174/45, 50; 175/45, 175/50
See application file for complete search history.

(56) References Cited

U.S. PATENT DOCUMENTS

| | | | | |
|---|---|---|---|---|
| 2,373,880 | A | 4/1945 | Driscoll | |
| 2,603,163 | A | 7/1952 | Nixon | |
| 2,874,783 | A | 2/1959 | Haines | |
| 2,880,805 | A | 4/1959 | Nelson et al. | |
| 2,915,011 | A | 12/1959 | Hamill | |
| 3,968,473 | A | 7/1976 | Patton et al. | |
| 4,407,374 | A | 10/1983 | Wallussek et al. | |
| 4,416,339 | A | 11/1983 | Baker et al. | |
| 4,463,814 | A | 8/1984 | Horstmeyer et al. | |
| 4,715,440 | A | 12/1987 | Boxell et al. | |
| 4,715,451 | A | 12/1987 | Bseisu et al. | |
| 4,773,263 | A | 9/1988 | Lesage et al. | |
| 4,844,178 | A | 7/1989 | Cendre et al. | |
| 4,924,180 | A * | 5/1990 | Nasr et al. | 324/207.15 |
| 4,947,944 | A | 8/1990 | Coltman et al. | |
| 4,957,173 | A | 9/1990 | Kinnan | |

(Continued)

FOREIGN PATENT DOCUMENTS

| | | |
|---|---|---|
| EP | 1174582 A3 | 1/2002 |
| GB | 2432176 | 5/2007 |

(Continued)

OTHER PUBLICATIONS

Chen, D.C.-K, Comeaux, B., Gillespie, G., Irvine, G., and Wiecek, B., "Real-Time Downhole Torsional Vibration Monitor for Improving Tool Performance and Bit Design," IADC/SPE Drilling Conference, Feb. 21-23, 2006, Miami, Florida.

(Continued)

*Primary Examiner* — Bot Ledynh
(74) *Attorney, Agent, or Firm* — Kimberly Ballew

(57) ABSTRACT

Aspects of this invention include a downhole tool having an angular position sensor disposed to measure the relative angular position between first and second members disposed to rotate about a common axis. A plurality of magnetic field sensors are deployed about the second member and disposed to measure magnetic flux emanating from first and second magnets deployed on the first member. A controller is programmed to determine the relative angular position based on magnetic measurements made by the magnetic field sensors. In a one exemplary embodiment, a downhole steering tool includes first and second magnets circumferentially spaced on the shaft and a plurality of magnetic field sensors deployed about the housing.

29 Claims, 7 Drawing Sheets

U.S. PATENT DOCUMENTS 4,958,125 A 9/1990 Jardine et al.
5,070,950 A 12/1991 Cendre et al.
5,168,941 A 12/1992 Krueger et al.
5,226,332 A 7/1993 Wassell
5,313,829 A 5/1994 Paslay et al.
5,355,950 A 10/1994 Zwart
5,448,911 A 9/1995 Mason
5,568,048 A * 10/1996 Schroeder et al. ..... 324/207.21
5,603,386 A 2/1997 Webster
5,629,480 A 5/1997 Herget
5,666,050 A 9/1997 Bouldin
5,685,379 A * 11/1997 Barr et al. ..... 175/61
5,721,376 A 2/1998 Pavone et al.
5,797,453 A 8/1998 Hisaw
5,864,058 A 1/1999 Chen
5,941,323 A 8/1999 Warren
6,065,332 A 5/2000 Dominick
6,068,394 A 5/2000 Dublin, Jr.
6,084,400 A * 7/2000 Steinich et al. ..... 324/207.13
6,092,610 A 7/2000 Kosmala et al.
6,148,933 A 11/2000 Hay et al.
6,158,529 A 12/2000 Dorel
6,215,120 B1 4/2001 Gadeken et al.
6,216,802 B1 4/2001 Sawyer
6,267,185 B1 7/2001 Mougel et al.
6,268,726 B1 7/2001 Prammer et al.
6,290,003 B1 9/2001 Russell
6,307,199 B1 10/2001 Edwards et al.
6,427,783 B2 8/2002 Krueger et al.
6,433,536 B1 * 8/2002 Yundt et al. ..... 324/207.22
6,518,756 B1 2/2003 Morys et al.
6,584,837 B2 7/2003 Kurkoski
6,608,565 B1 8/2003 Van Steenwyk et al.
6,609,579 B2 8/2003 Krueger et al.
6,647,637 B2 11/2003 Lechen
6,681,633 B2 1/2004 Schultz et al.
6,696,684 B2 2/2004 Radtke et al.
6,702,010 B2 3/2004 Yuratich et al.
6,742,604 B2 6/2004 Brazil et al.
6,761,232 B2 7/2004 Moody et al.
6,803,760 B2 * 10/2004 Jones et al. ..... 324/207.25
6,825,659 B2 11/2004 Prammer
6,848,189 B2 2/2005 Moake et al.
6,891,777 B2 5/2005 Pabon et al.
6,944,548 B2 9/2005 Radtke et al.
6,957,145 B2 10/2005 Spross
7,000,700 B2 2/2006 Cairns et al.
7,411,388 B2 * 8/2008 Sagoo et al. ..... 324/207.25
7,414,392 B2 * 8/2008 Parenti ..... 324/207.2
7,571,643 B2 8/2009 Sugiura
7,876,091 B2 * 1/2011 Tokunaga ..... 324/207.21
7,923,993 B2 * 4/2011 Takahashi et al. ..... 324/207.25
2002/0005715 A1 * 1/2002 Sato ..... 324/207.2
2002/0124652 A1 9/2002 Schultz et al.
2003/0184305 A1 10/2003 Niina
2004/0206170 A1 10/2004 Chen et al.
2004/0222019 A1 11/2004 Estes et al.
2004/0239313 A1 12/2004 Godkin
2004/0251898 A1 12/2004 Morys et al.
2005/0001737 A1 1/2005 Baron et al.
2005/0034985 A1 2/2005 Zamanzadeh et al.
2005/0140373 A1 6/2005 Li et al.
2005/0150694 A1 7/2005 Schuh
2005/0189938 A1 9/2005 Schley et al.
2005/0237054 A1 * 10/2005 Halder et al. ..... 324/207.21
2006/0021797 A1 2/2006 Krueger
2006/0185900 A1 8/2006 Jones et al.
2006/0185902 A1 8/2006 Song et al.
2007/0017705 A1 * 1/2007 Lasater ..... 175/61
2007/0030007 A1 2/2007 Moore

FOREIGN PATENT DOCUMENTS

WO WO-01-51761 A1 7/2001
WO WO-03-097989 A1 11/2003
WO WO2006/119294 9/2006
WO WO2007/014446 8/2007

OTHER PUBLICATIONS

Panasonic Hybrid IC brochure No. ENQ39, dated Mar. 2005.

* cited by examiner

ANGULAR POSITION SENSOR FOR A DOWNHOLE TOOL

RELATED APPLICATIONS

None.

FIELD OF THE INVENTION

The present invention relates generally to downhole tools, for example, including directional drilling tools having one or more steering blades. More particularly, embodiments of this invention relate to a sensor apparatus and a method for determining a relative angular position between various downhole tool components, such as a housing and a rotatable shaft.

BACKGROUND OF THE INVENTION

Measurement while drilling (MWD) and logging while drilling (LWD) tools are commonly used in oilfield drilling applications to measure physical properties of a subterranean borehole and the geological formations through which it penetrates. Such M/LWD techniques include, for example, natural gamma ray, spectral density, neutron density, inductive and galvanic resistivity, acoustic velocity, acoustic caliper, downhole pressure, and the like. Formations having recoverable hydrocarbons typically include certain well-known physical properties, for example, resistivity, porosity (density), and acoustic velocity values in a certain range.

In some drilling applications it is desirable to determine the azimuthal variation of particular formation and/or borehole properties (i.e., the extent to which such properties vary about the circumference of the borehole). Such information may be utilized, for example, to locate faults and dips that may occur in the various layers that make up the strata. In geo-steering applications, such "imaging" measurements are utilized to make steering decisions for subsequent drilling of the borehole. In order to make correct steering decisions, information about the strata is generally required. As described above, such information may possibly be obtained from azimuthally sensitive measurements of the formation properties.

Azimuthal imaging measurements typically make use of the rotation of the drill string (and therefore the LWD sensors) in the borehole during drilling. Conventional flux gate magnetometers are utilized to determine the magnetic toolface angle of the LWD sensor (which, as described in more detail below, is often referred to in the art as sensor azimuth) at the time a particular measurement or group of measurements are obtained by the sensor. However, conventional magnetometers have some characteristics that are not ideally suited to imaging applications. For example, flux gate magnetometers typically have a relatively limited bandwidth (e.g., about 5 Hz). Increasing the bandwidth requires increased power to increase the excitation frequency at which magnetic material is saturated and unsaturated. In LWD applications, electrical power is often supplied by batteries, making electrical power a somewhat scarce resource. For this reason, increasing the bandwidth of flux gate magnetometers beyond about 5 Hz is sometimes not practical in certain downhole applications. Moreover, conventional magnetometers are susceptible to magnetic interference from magnetic ores as well as from magnetic drill string components. For geo-steering applications, directional formation evaluation measurements are preferably made very low in the bottom hole assembly (BHA) as close to the drill bit as possible where high magnetic interference is known to exist. Magnetic interference from steering tool and mud motor components is known to interfere with magnetometer measurements.

Therefore, there exists a need for an improved sensor arrangement for making directional formation evaluation measurements. In particular, there is a need for a sensor arrangement suitable for making high frequency tool face angle measurements near the drill bit (e.g., in the body of a steering tool located just above the bit).

SUMMARY OF THE INVENTION

The present invention addresses one or more of the above-described drawbacks of prior art tools and methods. One exemplary aspect of this invention includes a downhole tool having an angular position sensor disposed to measure the relative angular position between first and second members disposed to rotate about a common axis. A plurality of magnetic field sensors are deployed about the second member and disposed to measure magnetic flux emanating from first and second magnets deployed on the first member. A controller is programmed to determine the relative angular position based on magnetic measurements made by the magnetic field sensors. In a one exemplary embodiment, a downhole steering tool includes first and second magnets circumferentially spaced on the shaft and a plurality of magnetic field sensors deployed about the housing.

Exemplary embodiments of the present invention may advantageously provide several technical advantages. For example, sensor embodiments in accordance with the present invention are non-contact and therefore not typically subject to mechanical wear. Moreover, embodiments of this invention tend to provide for accurate and reliable measurements with very little drift despite the high temperatures and pressures commonly encountered by downhole tools. Additionally, embodiments of the invention are typically small, low mass, and low cost and tend to require minimal maintenance.

Moreover, angular position sensor embodiments in accordance with this invention may be used in the presence of high magnetic interference, e.g., in a steering tool or a mud motor deployed low in the BHA. Exemplary embodiments of the invention may be utilized to make high frequency angular position measurements and thus tend to be suitable for making high frequency toolface measurements for LWD imaging applications. Sensor embodiments in accordance with this invention may also be advantageously utilized to measure relative rotation rates between first and second downhole tool components.

In one aspect the present invention includes a downhole tool. The tool includes first and second members disposed to rotate about a common axis with respect to one another. First and second circumferentially spaced magnets are deployed on the first member and a plurality of circumferentially spaced magnetic field sensors are deployed on the second member such that at least one of the magnetic field sensors is in sensory range of magnetic flux emanating from at least one of the magnets. The tool further includes a controller disposed to calculate an angular position of the first member with respect to the second member from magnetic flux measurements at the magnetic field sensors.

In another aspect this invention includes a downhole tool. The tool includes a shaft deployed to rotate substantially freely in a housing. First and second arc-shaped magnets are circumferentially spaced on the shaft such that the first magnet has a magnetic north pole on an outer surface and a magnetic south pole an inner surface thereof and the second magnet has a magnetic south pole on an outer surface and a magnetic north pole on an inner surface thereof. A plurality of circumferentially spaced magnetic field sensors are deployed in the housing such that at least one of the magnetic field sensors is in sensory range of magnetic flux emanating from at least one of the magnets. The tool further includes a controller deployed in the housing and disposed to determine a relative angular position between the housing and the shaft from magnetic flux measurements made by the magnetic field sensors.

In still another aspect this invention includes a method for determining a relative angular position between first and second members of a downhole tool. The method includes deploying a downhole tool in a borehole, the downhole tool including first and second members disposed to rotate about a common axis with respect to one another. First and second circumferentially spaced magnets are deployed on the first member and a plurality of circumferentially spaced magnetic field sensors are deployed on the second member. The method further includes causing each of the magnetic field sensors to measure a magnetic flux and processing the magnetic flux measurements to calculate the relative angular position between the first and second members.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
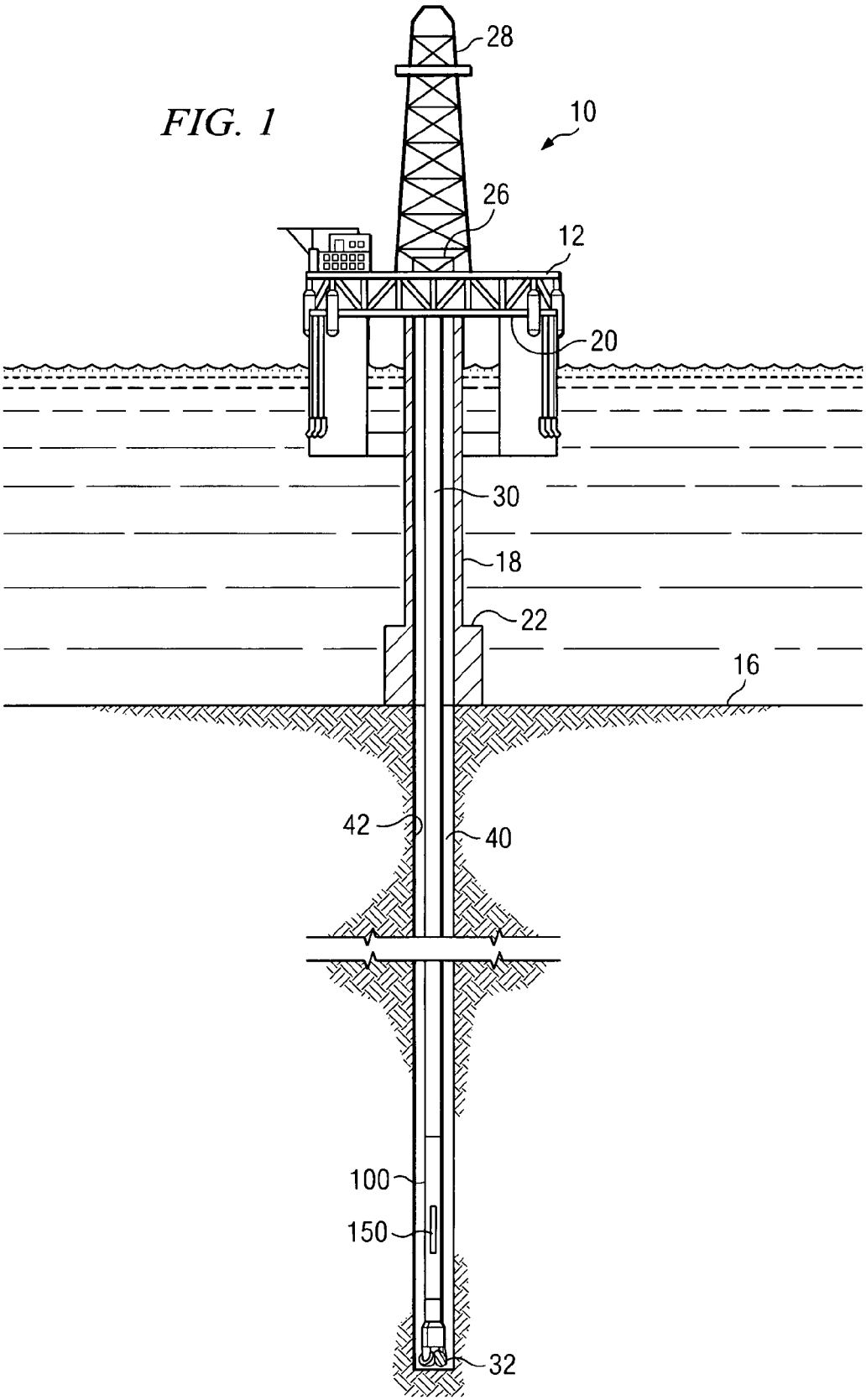
FIG. 1 depicts a drilling rig on which exemplary embodiments of the present invention may be deployed.

Before proceeding with a discussion of the present invention, it is necessary to make clear what is meant by "azimuth" as used herein. The term azimuth has been used in the downhole drilling arts in two contexts, with a somewhat different meaning in each context. In a general sense, an azimuth angle is a horizontal angle from a fixed reference position. Mariners performing celestial navigation used the term, and it is this use that apparently forms the basis for the generally understood meaning of the term azimuth. In celestial navigation, a particular celestial object is selected and then a vertical circle, with the mariner at its center, is constructed such that the circle passes through the celestial object. The angular distance from a reference point (usually magnetic north) to the point at which the vertical circle intersects the horizon is the azimuth. As a matter of practice, the azimuth angle was usually measured in the clockwise direction.

In this traditional meaning of azimuth, the reference plane is the horizontal plane tangent to the earth's surface at the point from which the celestial observation is made. In other words, the mariner's location forms the point of contact between the horizontal azimuthal reference plane and the surface of the earth. This context can be easily extended to a downhole drilling application. A borehole azimuth in the downhole drilling context is the relative bearing direction of the borehole at any particular point in a horizontal reference frame. Just as a vertical circle was drawn through the celestial object in the traditional azimuth calculation, a vertical circle may also be drawn in the downhole drilling context with the point of interest within the borehole being the center of the circle and the tangent to the borehole at the point of interest being the radius of the circle. The angular distance from the point at which this circle intersects the horizontal reference plane and the fixed reference point (e.g., magnetic north) is referred to as the borehole azimuth. And just as in the celestial navigation context, the borehole azimuth is typically measured in a clockwise direction.

It is this meaning of "azimuth" that is used to define the course of a drilling path. The borehole inclination is also used in this context to define a three-dimensional bearing direction of a point of interest within the borehole. Inclination is the angular separation between a tangent to the borehole at the point of interest and vertical. The azimuth and inclination values are typically used in drilling applications to identify bearing direction at various points along the length of the borehole. A set of discrete inclination and azimuth measurements along the length of the borehole is further commonly utilized to assemble a well survey (e.g., using the minimum curvature assumption). Such a survey describes the three-dimensional location of the borehole in a subterranean formation.

A somewhat different meaning of "azimuth" is found in some borehole imaging art. In this context, the azimuthal reference plane is not necessarily horizontal (indeed, it seldom is). When a borehole image of a particular formation property is desired at a particular point in the borehole, measurements of the property are taken at points around the circumference of the measurement tool. The azimuthal reference plane in this context is the plane centered at the measurement tool and perpendicular to the longitudinal direction of the borehole at that point. This plane, therefore, is fixed by the particular orientation of the borehole measurement tool at the time the relevant measurements are taken.

An azimuth in this borehole imaging context is the angular separation in the azimuthal reference plane from a reference point to the measurement point. The azimuth is typically measured in the clockwise direction, and the reference point is frequently the high side of the borehole or measurement tool, relative to the earth's gravitational field, though magnetic north may be used as a reference direction in some situations. Though this context is different, and the meaning of azimuth here is somewhat different, this use is consistent with the traditional meaning and use of the term azimuth. If the longitudinal direction of the borehole at the measurement point is equated to the vertical direction in the traditional context, then the determination of an azimuth in the borehole imaging context is essentially the same as the traditional azimuthal determination.

Another important label used in the borehole imaging context is "toolface angle". When a measurement tool is used to gather azimuthal imaging data, the point of the tool with the measuring sensor is identified as the "face" of the tool. The toolface angle, therefore, is defined as the angular separation from a reference point to the radial direction of the toolface. The assumption here is that data gathered by the measuring sensor will be indicative of properties of the formation along a line or path that extends radially outward from the toolface into the formation. The toolface angle is an azimuth angle, where the measurement line or direction is defined for the position of the tool sensors. The oilfield services industry uses the term "gravitational toolface" when the toolface angle has a gravity reference (e.g., the high side of the borehole) and "magnetic toolface" when the toolface angle has a magnetic reference (e.g., magnetic north).

In the remainder of this document, when referring to the course of a drilling path (i.e., a drilling direction), the term "borehole azimuth" will be used. Thus, a drilling direction may be defined, for example, via a borehole azimuth and an inclination (or borehole inclination). The terms toolface and azimuth will be used interchangeably, though the toolface identifier will be used predominantly, to refer to an angular position about the circumference of a downhole tool (or about the circumference of the borehole). Thus, an LWD sensor, for example, may be described as having an azimuth or a toolface.

Referring first to FIGS. 1 to 10, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 to 10 may be described herein with respect to that reference numeral shown on other views.

FIG. 1 illustrates a drilling rig 10 suitable for utilizing exemplary downhole tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a directional drilling tool 100 (such as a three-dimensional rotary steerable tool). In the exemplary embodiment shown, steering tool 100 includes one or more, usually three, blades 150 disposed to extend outward from the tool 100 and apply a lateral force and/or displacement to the borehole wall 42. The extension of the blades deflects the drill string 30 from the central axis of the borehole 40, thereby changing the drilling direction. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. Moreover, while the invention is described with respect to exemplary three-dimensional rotary steerable (3DRS) tool embodiments, it will also be understood that the present invention is not limited in this regard. The invention is equally well suited for use in substantially any downhole tool requiring an angular position measurement of one component (e.g., a shaft) with respect to another (e.g., a sleeve deployed about the shaft).

Figure 2:
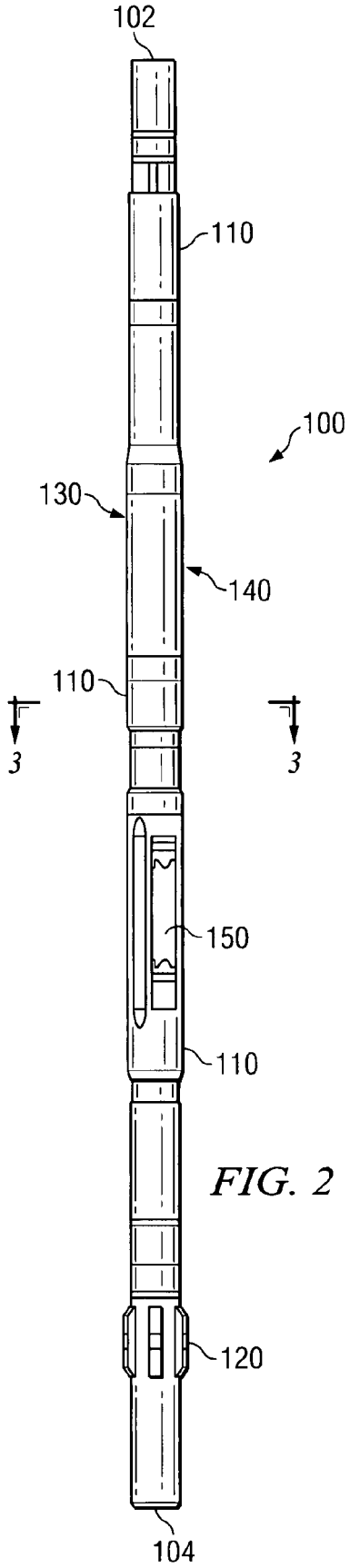
FIG. 2 is a perspective view of the steering tool shown on FIG. 1.

Turning now to FIG. 2, one exemplary embodiment of rotary steerable tool 100 from FIG. 1 is illustrated in perspective view. In the exemplary embodiment shown, rotary steerable tool 100 is substantially cylindrical and includes threaded ends 102 and 104 (threads not shown) for connecting with other bottom hole assembly (BHA) components (e.g., connecting with the drill bit at end 104). The rotary steerable tool 100 further includes a housing 110 deployed about a shaft (not shown on FIG. 2). The shaft is typically configured to rotate relative to the housing 110. The housing 110 further includes at least one blade 150 deployed, for example, in a recess (not shown) therein. Directional drilling tool 100 further includes hydraulics 130 and electronics 140 modules (also referred to herein as control modules 130 and 140) deployed in the housing 110. In general, the control modules 130 and 140 are configured for sensing and controlling the relative positions of the blades 150. As described in more detail below, electronic module also typically includes a tri-axial arrangement of accelerometers with one of the accelerometer having a known orientation relative to the longitudinal axis of the tool 100.

To steer (i.e., change the direction of drilling), one or more of blades 150 are extended and exert a force against the borehole wall. The rotary steerable tool 100 is moved away from the center of the borehole by this operation, thereby altering the drilling path. In general, increasing the offset (i.e., increasing the distance between the tool axis and the borehole axis via extending one or more of the blades) tends to increase the curvature (dogleg severity) of the borehole upon subsequent drilling. The tool 100 may also be moved back towards the borehole axis if it is already eccentered. It will be understood that the drilling direction (whether straight or curved) is determined by the positions of the blades with respect to housing 110 as well as by the angular position (i.e., the azimuth) of the housing 110 in the borehole.

Angular Sensor Embodiments

Figure 3:
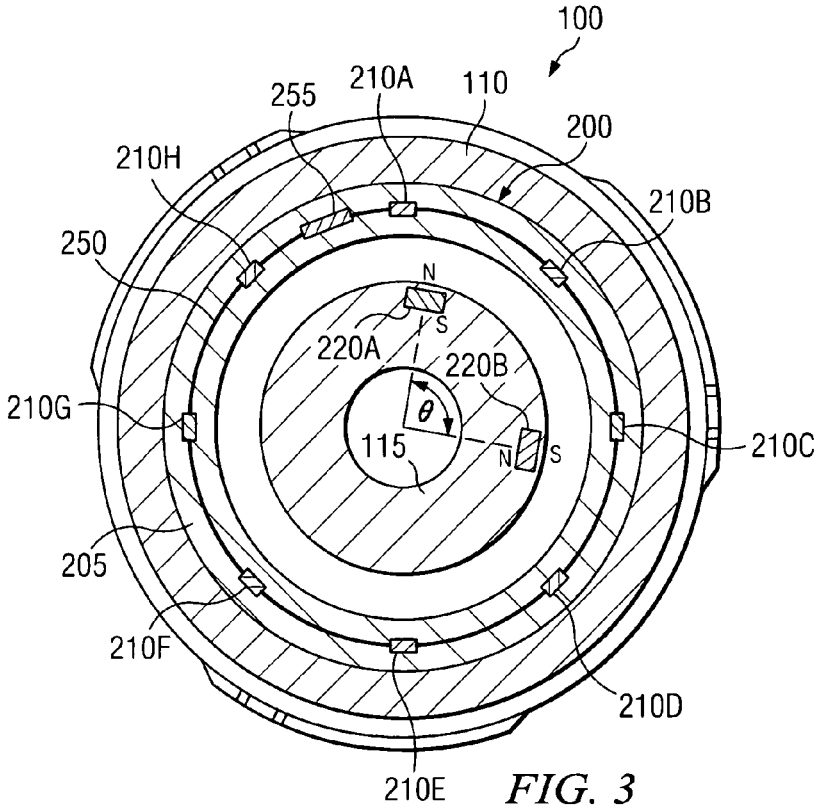
FIG. 3 depicts, in cross section, an exemplary angular sensor deployment in accordance with the present invention.

With reference now to FIG. 3, one exemplary embodiment of an angular sensor 200 in accordance with the present invention is depicted in cross section. Angular sensor 200 is disposed to measure the relative angular position between shaft 115 and housing 110 and may be deployed, for example, in control module 140 (FIG. 2). In the exemplary embodiment shown, angular sensor 200 includes first and second magnets 220A and 220B deployed on the shaft 115 and a plurality of magnetic field sensors 210A-H deployed about the circumference of the housing 110. The invention is not limited in this regard, however, as the magnets 220A and 220B may be deployed on the housing 110 and magnetic field sensors 210A-H on the shaft 115.

Magnets 220A and 220B are angularly offset about the circumference of the shaft 115 by an angle θ. In the exemplary embodiment shown, magnets 220A and 220B are angularly offset by an angle of 90 degrees; however, the invention is not limited in this regard. Magnets 220A and 220B may be angularly offset by substantially any suitable angle. Angles in the range from about 30 to about 180 degrees are generally advantageous. Magnets 220A and 220B also typically have substantially equal magnetic pole strengths and opposite polarity, although the invention is expressly not limited in this regard. In the exemplary embodiment shown on FIG. 3, magnet 220A includes an approximately cylindrical magnet having a magnetic north pole facing radially outward from the tool axis while magnetic 220B includes an approximately cylindrical magnet having a magnetic south pole facing radially outward towards the tool axis. It will be appreciated that other more complex magnetic arrangements may be utilized. Certain other arrangements are described in more detail below with respect to FIGS. 5-8B. In one other alternative arrangement, magnets 220A and 220B may each include first and second magnets having opposing magnetic poles facing one another such that magnetic flux emanates radially outward from the tool axis (or inward towards the tool axis depending upon the polarity of the magnets). In such an embodiment, magnet 220A may include north-north opposing poles, for example, while magnet 220B may include south-south opposing poles.

With continued reference to FIG. 3, magnetic field sensors 210A-H are deployed about the circumference of the tool 100 such that at least two of the sensors 210A-H are within sensory range of magnetic flux emanating from the magnets 220A and 220B. In the exemplary embodiment shown, at least sensors 210A and 210C are in sensory range of the magnetic flux. Magnetic field sensors 210A-H may include substantially any type of magnetic sensor, e.g., including magnetometers, reed switches, magnetoresistive sensors, and/or Hall-Effect sensors, however magnetoresistive sensors and Hall-Effect sensors are generally preferred. Moreover, each sensor may have either a ratiometric (analog) or digital output. While FIG. 3 shows eight magnetic field sensors 210A-H, it will be appreciated by those of ordinary skill on the art that this invention may equivalently utilize substantially any suitable plurality of magnetic field sensors. Typically from about four to about sixteen sensors are preferred. Too few sensors tend to result in a degradation of angular sensitivity (although degraded angular sensitivity may be acceptable, for example, in certain LWD imaging applications in which the LWD sensor has poor angular sensitivity). The use of sixteen or more sensors, while providing excellent angular sensitivity, increases wiring and power requirements while also tending to negatively impact system reliability.

In the exemplary embodiment shown on FIG. 3, each magnetic field sensor 210A-H is deployed so that its axis of sensitivity is substantially radially aligned (i.e., pointing towards the center of the shaft 115), although the invention is not limited in this regard. It will be appreciated by those of ordinary skill in the art that a magnetic sensor is typically sensitive only to the component of the magnetic flux that is aligned (parallel) with the sensor's axis of sensitivity. It will also be appreciated that the exemplary embodiment shown on FIG. 3 results in magnetic flux lines that are substantially radially aligned adjacent magnets 220A and 220B. Therefore, the magnetic sensor 210A-H located closest to magnet 220A tends to sense the highest positive magnetic flux (magnetic flux directed outward for the tool axis) and the sensor closest to magnet 220B tends to sense the highest negative magnetic flux (magnetic flux directed inward towards the tool axis). For example, in the exemplary embodiment shown, magnetic sensor 210A tends to measure the highest positive magnetic flux while sensor 210C tends to measure the highest negative magnetic flux. The invention is not limited by the exemplary sensor orientation depicted on FIG. 3.

Figure 4A:
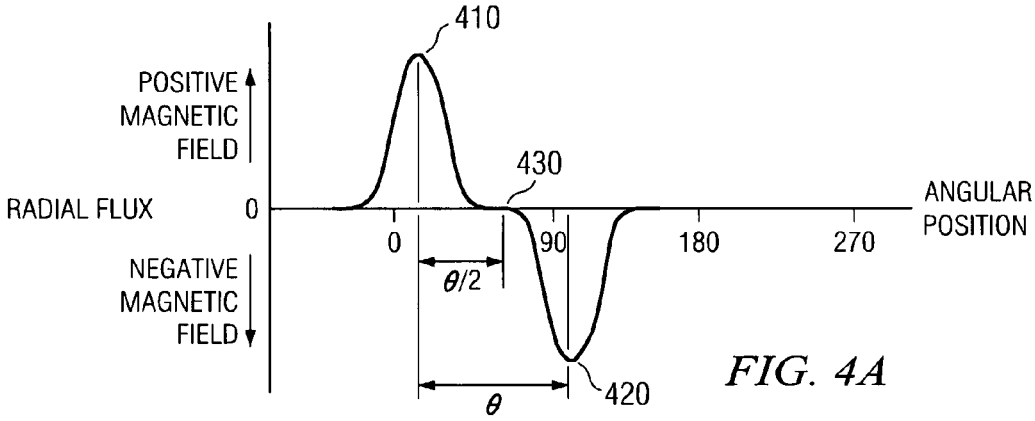
FIG. 4A depicts a plot of magnetic field strength versus angular position emanating from the magnets in the angular sensor deployment shown on FIG. 3.

With reference now to FIG. 4A, a plot of the radial flux emanating from magnets 220A and 220B versus angular position about the shaft 115 is depicted. Note that the radial flux includes positive 510 and negative 520 maxima. As described above, the positive maximum 510 is located radially outward from magnet 220A (i.e., at about 15 degrees in the exemplary embodiment shown). The negative maximum 520 is located radially outward from magnet 220B (i.e., at about 105 degrees in the exemplary embodiment shown). A magnetic flux null 530 (also referred to as a zero-crossing) is located between the positive 510 and negative 520 maxima (i.e., at about 60 degrees in the exemplary embodiment shown). The radial flux depicted in FIG. 4A is for an exemplary embodiment in which the shaft 115 and housing 110 are fabricated from a non-magnetic steel. For embodiments in which the shaft and/or housing are fabricated from a magnetic steel (or other magnetically permeable material), the positive and negative maxima 510 and 520 typically become more sharply defined with respect to angular position. Notwithstanding, it will be appreciated that the relative rotational position of the magnets 220A and 220B (and therefore the shaft) with respect to the magnetic sensors 210A-H (and therefore the housing 110) may be determined by locating the positive and/or negative maxima 510 and 520 or the zero-crossing 530.

Figure 4B:
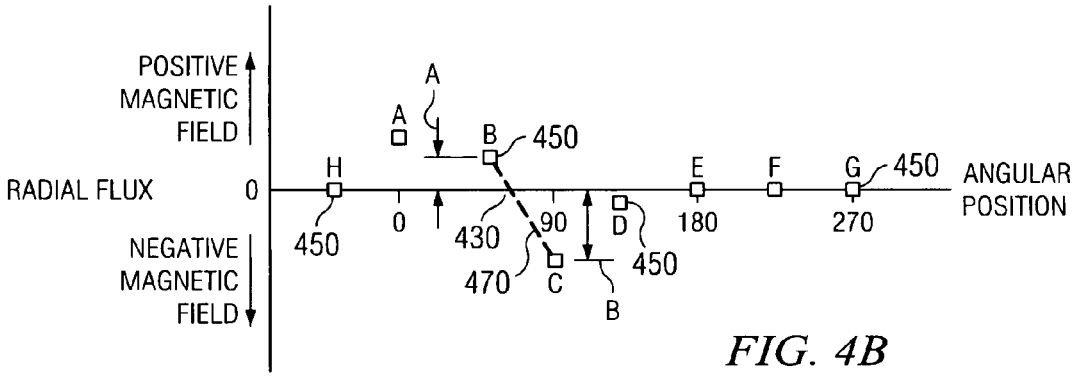
FIG. 4B depicts a plot of exemplary magnetic field strength measurements made by each of the magnetic sensors in the angular sensor deployment shown on FIG. 3.

With reference now to FIG. 4B, a graphical representation of one exemplary mathematical technique for determining the angular position is illustrated. Data points 450 represent the magnetic field strength as measured by each of sensors 210A-H on FIG. 3. In this exemplary sensor embodiment, the angular position half way between magnets 220A and 220B is indicated by zero-crossing 430, the location on the circumferential array of magnetic field sensors at which the magnetic flux is substantially null and at which the polarity of the magnetic field changes from positive to negative (or negative to positive). In the exemplary embodiment shown, zero-crossing 430 is at an angular position of about 60 degrees (as described above with respect to FIG. 3). Note that the position of the zero crossing 430 (and therefore the angular position half way between the magnets 220A and 220B) is located between sensors 210B and 210C. In one exemplary method embodiment, a processor (such as processor 255) first selects adjacent sensors (e.g., sensors 210B and 210C) between which the sign of the magnetic field changes (from positive to negative or negative to positive). The position of the zero crossing 430 may then be determined, for example, by fitting a straight line 470 through the data points on either side of the zero crossing (e.g., between the measurements made by sensors 210B and 210C in the embodiment shown on FIG. 4B). The location of the zero crossing 820 may then be determined mathematically from the magnetic field measurements, for example, as follows:

$$P = L\left(x + \frac{A}{A+B}\right) \quad \text{Equation 1}$$

where P represents the angular position of the zero crossing, L represents the angular distance interval between adjacent sensors in degrees (e.g., 45 degrees in the exemplary embodiment shown on FIGS. 3 and 5), A and B represent the absolute values of the magnetic field measured on either side of the zero crossing (A and B are shown on FIGS. 4B and 7B), and x is a counting variable having an integer value representing the first of the two adjacent sensors positioned on either side of the zero crossing (such that x=1 for sensor 210A, x=2 for sensor 210B, x=3 for sensor 210C, and so on). In the exemplary embodiments shown on FIGS. 4B and 7B, x=2 (sensor 210B).

It will be appreciated that the magnet arrangement shown on FIG. 3 (including magnets 220A and 220B) tends to result angular position values having small, systematic errors at certain angular positions due to the non-linearly of the magnetic flux profile as a function of angular position. This error is readily corrected, when necessary, using known calibration methods (e.g., look-up tables or polynomial fitting). It will also be appreciated that the magnet arrangement shown on FIG. 3 advantageously makes use of inexpensive and readily available off-the-shelf magnets (e.g., square, rectangular or cylindrical magnets).

Figure 5:
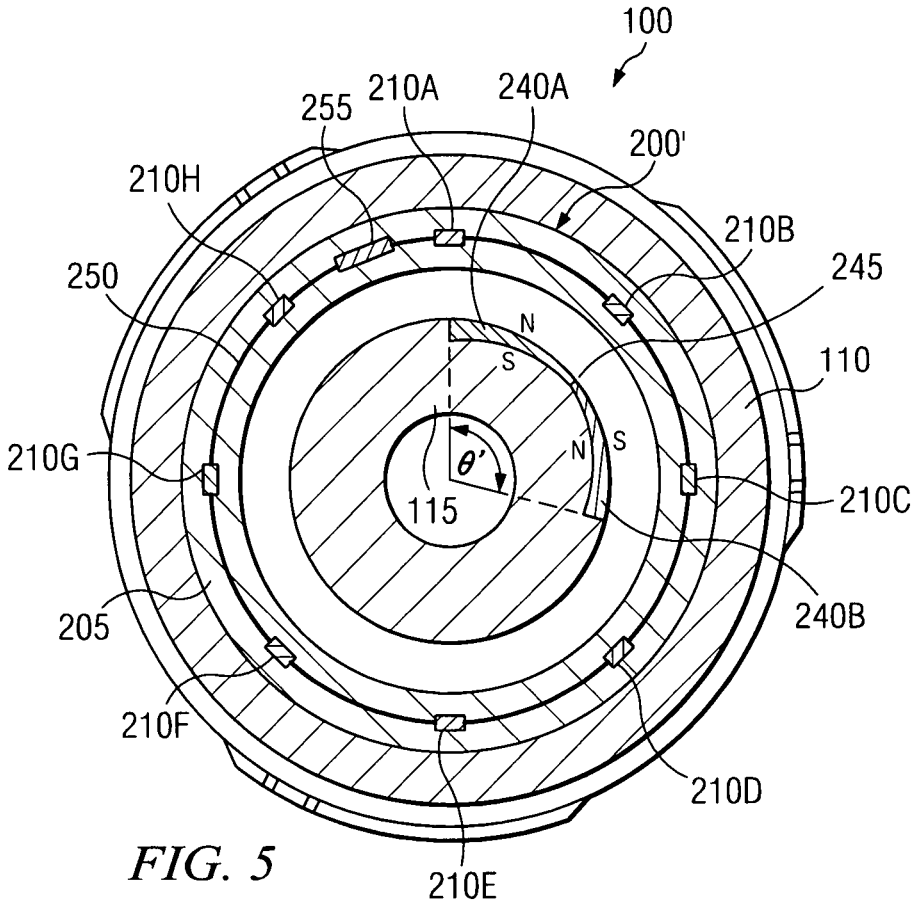
FIG. 5 depicts, in cross section, another exemplary angular sensor deployment in accordance with the present invention.

Turning now to FIG. 5, an alternative embodiment of an angular sensor 200' in accordance with the present invention is depicted in cross section. Angular sensor 200' is also disposed to measure the relative angular position between shaft 115 and housing 110 and may be deployed, for example, in control module 140 (FIG. 2). Sensor 200' is substantially identical to sensor 200 with the exception that it includes first and second tapered, arc-shaped magnets 240A and 240B (also referred to herein as eyebrow magnets) deployed on the shaft 115. One exemplary embodiment of eyebrow magnet 240A is also shown on FIG. 6. Eyebrow magnets 240A and 240B include inner and outer faces 242 and 244, with the outer face 244 having a radius of curvature approximately equal to that of the outer surface of the shaft 115. Eyebrow magnets 240A and 240B also include relatively thick 246 and relatively thin 248 ends. While the invention is not limited in this regard, the thickness of end 246 is at least four times greater than that of end 248 in one exemplary embodiment.

Figure 6:
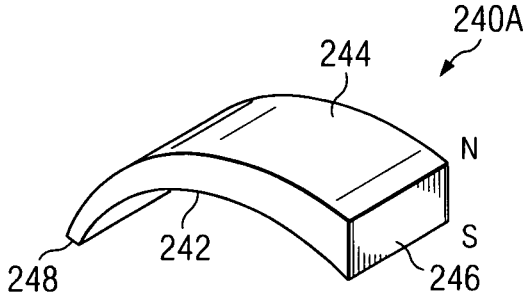
FIG. 6 depicts a perspective view of an exemplary eyebrow magnet utilized in the angular sensor deployment shown on FIG. 5.

In the exemplary embodiment shown, magnets 240A and 240B are substantially identical in shape and have substantially equal and opposite magnetic pole strengths. Magnet 240A includes a magnetic north pole on its outer face 244 and a magnetic south pole on its inner face 242 (FIG. 6). Magnet 240B has the opposite polarity with a magnetic south pole on its outer face 244 and a magnetic north pole on its inner face 242. Magnets 240A and 240B are typically deployed adjacent to one another about the shaft 115 such that their thin ends 248 are in contact (or near contact) with one another. While FIG. 5 shows an exemplary embodiment in which the magnets 240A and 240B are deployed in a tapered recess in the outer surface of the shaft, it will be appreciated that magnets 240A and 240B may be equivalently deployed on the outer surface of the shaft 115. The invention is not limited in these regards. In the exemplary embodiment shown, magnets 240A and 240B each span a circular arc of about 55 degrees about the circumference of the shaft. Thus magnets 240A and 240B in combination span a circular arc θ' of about 110 degrees. The invention is also not limited in these regards (as described in more detail below).

Figure 7A:
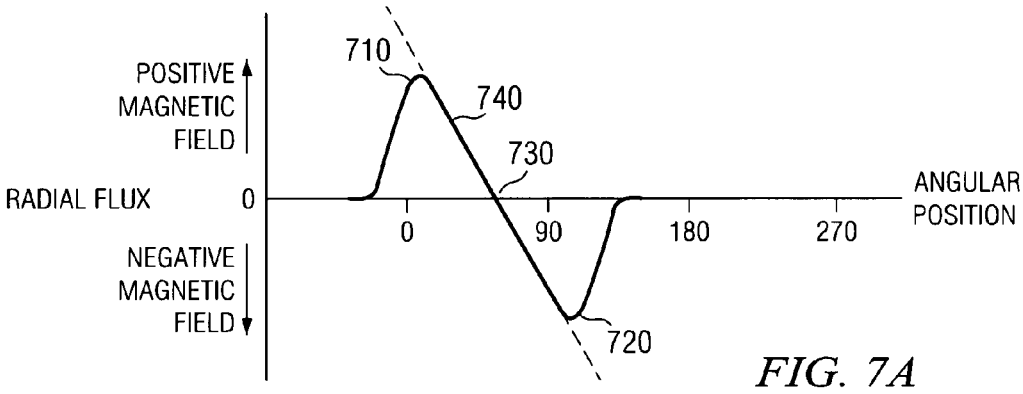
FIG. 7A depicts a plot of magnetic field strength versus angular position emanating from the magnets in the angular sensor deployment shown on FIG. 6.

With reference now to FIG. 7A, a plot of the radial flux emanating from magnets 240A and 240B versus angular position about shaft 115 is depicted. Similar to the embodiment described above with respect to FIGS. 3-4B, the radial flux includes positive 710 and negative 720 maxima. The positive maximum 710 is located radially outward from and near the thick end 246 of magnet 240A (i.e., at an angle of about 5-10 degrees in the exemplary embodiment shown). The negative maximum 720 is located radially outward from and near the thick end of magnet 240B (i.e., at about 100-105 degrees in the exemplary embodiment shown). A magnetic flux null 730 (also referred to as a zero-crossing) is located between the positive 710 and negative 720 maxima (i.e., at about 55 degrees in the exemplary embodiment shown). Moreover, as shown at 740, the radial flux is advantageously substantially linear with angular position between the maxima 710 and 720, which typically eliminates the need for correction algorithms. As described above with respect to angular sensor 200, the relative rotational position of the magnets 240A and 240B (and therefore the shaft) with respect to the magnetic sensors 210A-H (and therefore the housing 110) may be determined from the positive and/or negative maxima 710 and 720 or the zero-crossing 730.

With continued reference to FIG. 7A, and with reference again to FIGS. 5 and 6, eyebrow magnets 240A and 240B may be advantageously sized and shaped to generate a magnetic flux that varies linearly 740 with angular position between the positive and negative maxima 710 and 720. In the exemplary embodiment shown, this linear region 740 spans approximately 95 degrees in angular position. The invention is not limited in this regard, however, as the angular expanse of the linear region 740 may be increased by increasing the arc-length of magnets 240A and 240B and decreased by decreasing the arc-length of magnets 240A and 240B. In general, it is desirable for substantially linear region 740 to have an angular expanse of at least twice the angular interval between adjacent ones of magnetic sensors 210A-H. In this way at least two of the magnetic sensors 210A-H are located in the linear region 740 at all relative angular positions. It will thus be understood that embodiments of the invention utilizing fewer magnetic field sensors desirably utilize eyebrow magnets having a longer arc-length (e.g., about 90 degrees each for an embodiment including five magnetic field sensors). Likewise, embodiments of the invention utilizing more magnetic field sensors may optionally utilize eyebrow magnets having a shorter arc-length (e.g., about 30 degrees each for an embodiment including 16 magnetic field sensors).

Eyebrow magnets 240A and 240B are also advantageously sized and shaped to generate the above described magnetic flux profile (as a function of angular position) for tool embodiments in which both the shaft 115 and the housing 110 are fabricated from a magnetic material such as 4145 low alloy steel. It will be readily understood by those of ordinary skill in the art that the use of magnetic steel is advantageous in that it tends to significantly reduce manufacturing costs (due to the increased availability and reduced cost of the steel itself) and also tends to increase overall tool strength. Notwithstanding, magnets 240A and 240B may also be sized and shaped to generate the above described magnetic profile for tool embodiments in which either one or both of the shaft 115 and the housing 110 are fabricated from nonmagnetic steel.

Figure 7B:
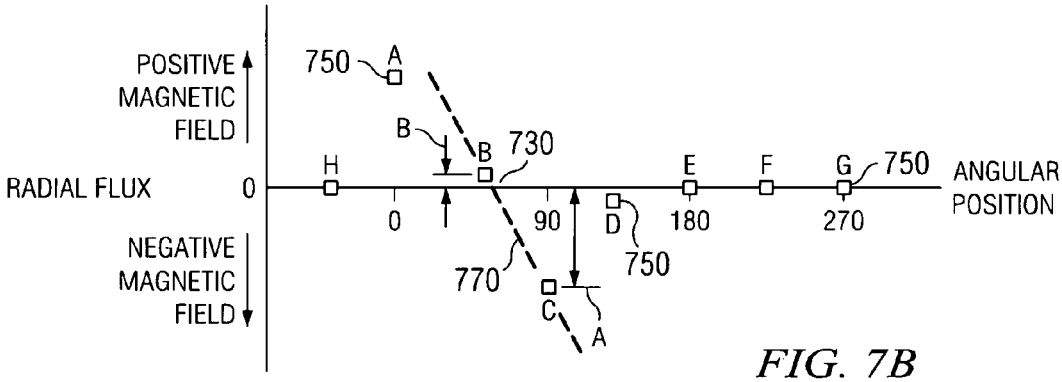
FIG. 7B depicts a plot of exemplary magnetic field strength measurements made by each of the magnetic sensors in the angular sensor deployment shown on FIG. 6.
Figure 8A:
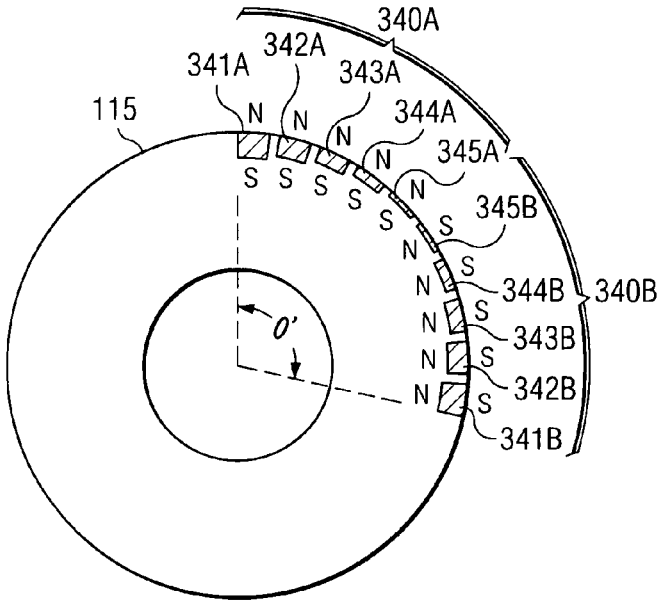
FIGS. 8A and 8B depict alternative magnet configurations suitable for use in the angular position sensor shown on FIG. 5.
Figure 9B:
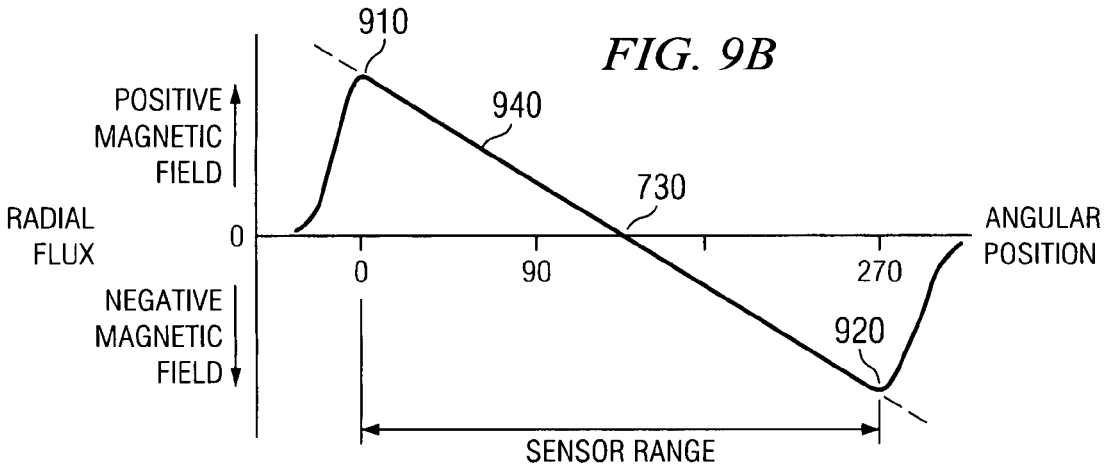
FIG. 9B depicts a plot of magnetic field strength versus angular position emanating from the magnets in the angular sensor deployment shown on FIG. 9A.

With reference now to FIG. 7B, a graphical representation of one exemplary mathematical technique for determining the angular position is illustrated. The technique illustrated in FIG. 7B is similar to that described above with respect to FIG. 4B. Data points 750 represent the magnetic field strength values measured by sensors 210A-H on FIG. 5. In this embodiment, the angular position of the contact point 245 between magnets 240A and 240B is indicated by zero-crossing 730, which as described above is the location on the circumferential array of magnetic field sensors 210A-H at which the magnetic flux is substantially null and at which the polarity of the magnetic field changes from positive to negative (or negative to positive). In the exemplary embodiment shown, zero-crossing 730 is at an angular position of about 55 degrees (as described above with respect to FIGS. 5 and 7A). Note that the position of the zero crossing 730 (and therefore the angular position of contact point 245) is located between sensors 210B and 210C. Thus, as described above, a processor may first select adjacent sensors (e.g., sensors 210B and 210C) between which the sign of the magnetic field changes (from positive to negative or negative to positive). The position of the zero crossing 730 may then be determined, for example, by fitting a straight line 770 through the data points on either side of the zero crossing (e.g., between the measurements made by sensors 210B and 210C in the embodiment shown on FIG. 7B). The location of the zero crossing 730 may then be determined mathematically from the magnetic field measurements, for example, via Equation 1 as described above.

It will be appreciated that substantially any other suitable magnet configurations may be utilized to achieve a magnetic profile having a linear region similar to that described above with respect to FIG. 7A. For example, arc shaped magnets having a constant thickness, but a "tapered magnetization" such that the magnetic strength of each magnet increases from one end to another may be suitable substitutes for magnets 240A and 240B shown on FIG. 5. Alternatively, in the exemplary embodiment depicted in FIG. 8A, eyebrow magnets 240A and 240B (FIG. 5) have been replaced with sets 340A and 340B of discrete magnets. Set 340A includes a plurality of discrete magnets in which magnet 341A is thicker than magnet 342A, which is thicker than magnet 343A and so on for magnets 344A and 345A. Likewise, set 340B includes a plurality of discrete magnets in which magnet 341B is thicker than magnet 342B, which is thicker than magnet 343B and so on for magnets 344B and 345B. Alternatively, each of the magnets in sets 340A and 340B may have substantially the same thickness, but have a decreasing magnetic field strength from magnet 341A to 345A and from magnet 341B to 345B. It will be understood by those of ordinary skill that increasing the number of magnets in sets 340A and 340B tends to result in a magnetic flux profile more closely approximating that shown on FIG. 7A.

Figure 8B:
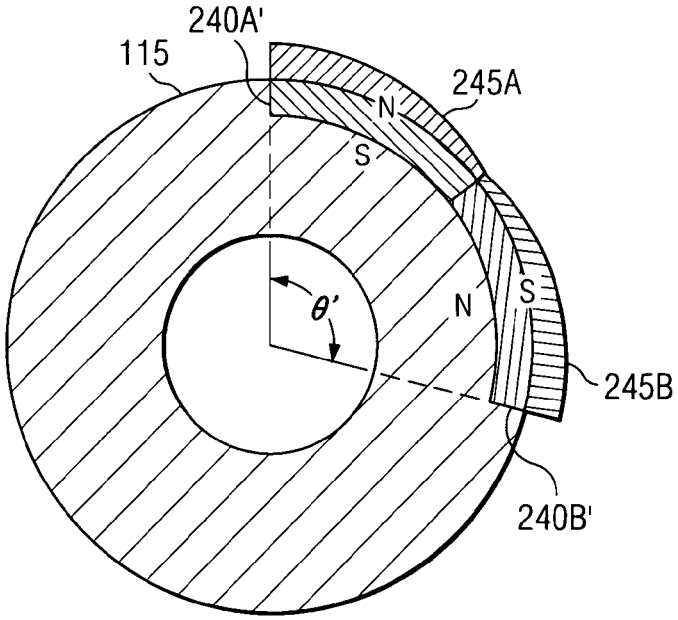

In the exemplary embodiment depicted in FIG. 8B, eyebrow magnets 240A and 240B (FIG. 5) have been replaced by arc-shaped magnets 240A' and 240B'. The exemplary embodiment shown further includes tapered, arc-shaped magnetic lenses 245A and 245B deployed about the corresponding magnets 240A' and 240B' (i.e., radially between the magnets and the magnetic field sensors 210A-H). Magnetic lenses 245A and 245B are fabricated from a magnetic material (magnetically permeable material), such as 4145 low alloy steel, and serve to focus magnetic flux emanating from magnets 240A' and 240B' such that the magnetic flux profile about the shaft approximates that described above with respect to FIG. 7A.

The exemplary angular position sensor embodiments shown on FIGS. 3 and 5 include magnetic sensors 210A-H deployed at equal angular intervals about the circumference of housing 110. It will be appreciated that the invention is not limited in this regard. Magnetic sensors 210A-H may alternatively be deployed at unequal intervals. For example, more sensors may be deployed on a one side of the housing 110 than on an opposing side to provide better angular sensitivity on that side of the tool. Nor is the invention limited to embodiments capable of measuring an angular position about the full circumference of the tool. Thus, certain embodiments may include magnetic sensors about only a portion of the housing circumference. Measurements about only a portion of the circumference may be advantageous, for example, in measuring the angular position of a hinged object. It will also be appreciated that angular position sensors 200 and 200' are not limited to embodiments in which the magnets are deployed on the shaft 115 and the magnetic sensors 210A-H in the housing. The magnets may be equivalently deployed in the housing 110 and the magnetic sensors 210A-H on the shaft.

Figure 9A:
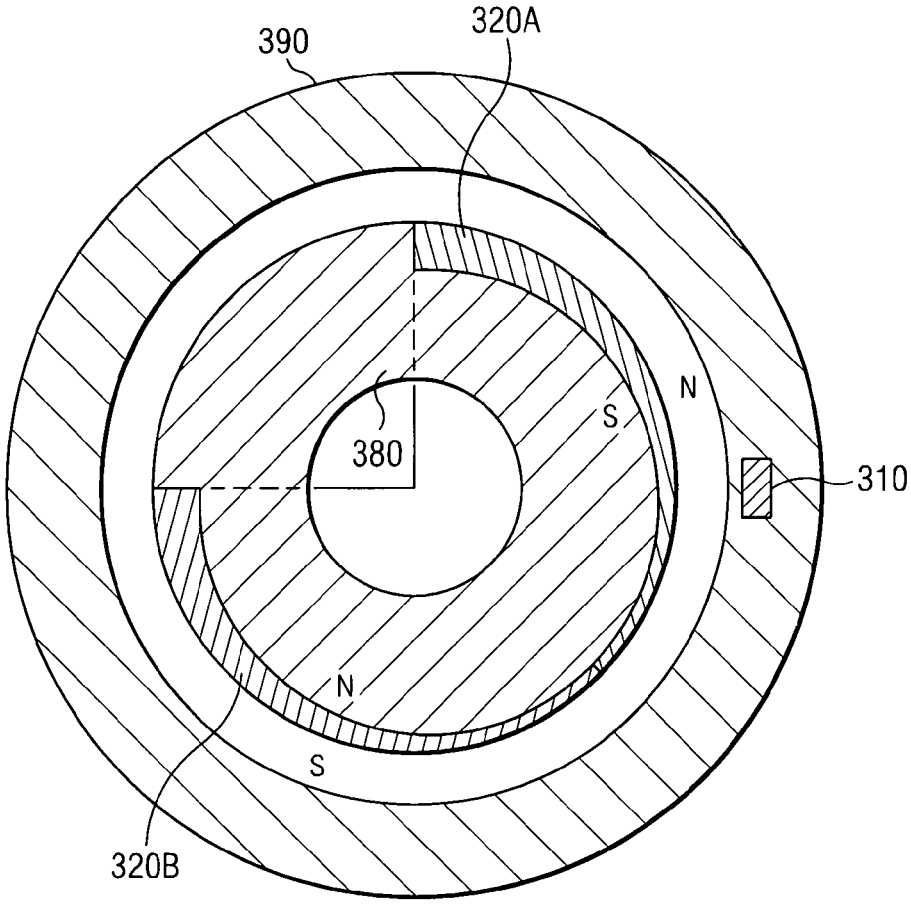
FIG. 9A depicts, in cross section, still another exemplary angular sensor deployment in accordance with the present invention.

With reference now to FIG. 9A, another exemplary embodiment of an angular position sensor 300 in accordance with the present invention is depicted. Angular position sensor 300 is configured to measure the angular position between housing 390 and shaft 380 about a portion of the circumference (from about 0 to about 270 degrees in the exemplary embodiment shown). Angular position sensor 300 includes first and second eyebrow magnets 320A and 320B and only a single magnetic field sensor 310. The radial flux about the circumference of shaft 380 is plotted on FIG. 9B. As shown at 940, the radial flux is advantageously substantially linear with angular position between maxima 910 and 920. As such the angular position may be advantageously determined directly from the measured flux density, for example, via a look up table or an equation of the form: $P=mF+b$, where P represents the angular position, m represents the slope of linear region 940 (e.g., in degrees per Gauss), F represents the magnetic flux density measured at magnetic field sensor 310, and b represents the angular position of zero crossing 930 (135 degrees in the exemplary embodiment shown). It will be readily understood by those of ordinary skill in the art that measurement accuracy may be increased according to known calibration techniques. Such calibration techniques may account, for example, for misalignment errors or downhole temperature fluctuations.

It will be appreciated that angular position sensing methods described above with respect to FIGS. 3 through 7B and Equation 1 advantageously require minimal computational resources (minimal processing power), which is critical in downhole applications in which 8-bit microprocessors are commonly used. These methods also provide accurate angular position determination about substantially the entire circumference of the tool. The zero-crossing method tends to be further advantageous in that a wider sensor input range is available (from the negative to positive saturation limits of the sensors).

It will also be appreciated that downhole tools must typically be designed to withstand shock levels in the range of 1000 G on each axis and vibration levels of 50 G root mean square. Moreover, downhole tools are also typically subject to pressures ranging up to about 25,000 psi and temperatures ranging up to about 200 degrees C. With reference again to FIGS. 3 and 5, magnetic field sensors 210A-H are shown deployed in a pressure resistant housing 205. Such an arrangement is preferred for downhole applications utilizing solid state magnetic field sensors such as Hall-Effect sensors and magnetoresistive sensors. In the exemplary embodiment shown, pressure housing 205 includes a sealed ring that is configured to resist downhole pressures which can damage sensitive electronic components. The pressure housing 205 is also configured to accommodate the magnetic field sensors 210A-H and other optional electronics, such as processor 255. Advantageous embodiments of the pressure housing 205 are fabricated from nonmagnetic material, such as P550 (austenitic manganese chromium steel). In the exemplary embodiment shown, magnetic field sensors 210A-H are deployed on a circumferential circuit board array 250, which is fabricated, for example from a flexible, temperature resistant material, such as PEEK (polyetheretherketone). The circumferential array 250, including the magnetic field sensors 210A-H and processor 255, is also typically encapsulated in a potting material to improve resistance to shocks and vibrations.

The magnets utilized in this invention are also typically selected in view of demanding downhole conditions. For example, suitable magnets must posses a sufficiently high Curie temperature to prevent demagnetization at downhole temperatures. Samarium cobalt ($SaCo_5$) magnets are typically preferred in view of their high Curie Temperatures (e.g., from about 700 to 800 degrees C.). To provide further protection from downhole conditions, the magnets may also be deployed in a shock resistant housing, for example, including a non-magnetic sleeve deployed about the magnets and shaft 115.

In the exemplary embodiments shown on FIGS. 3 and 5, the output of each magnetic sensor may be advantageously electronically coupled to the input of a local microprocessor. The microprocessor serves to process the data received by the magnetic sensors (e.g., according to Equation 1 as described above). In preferred embodiments, the microprocessor (such as processor 255) is embedded with the magnetic field sensors 210A-H in the circumferential array 250, for example, as shown on FIGS. 3 and 5 and therefore located close to the magnetic sensors. In such an embodiment, the microprocessor output (rather than the signals from the individual magnetic sensors) is typically electronically coupled with a main processor which is deployed further away from the magnetic field sensors (e.g., deployed in control module 140 as shown on FIG. 2). This configuration advantageously reduces wiring and feed-through requirements in the body of the downhole tool, which is particularly important in smaller diameter tool embodiments (e.g., tools having a diameter of less than about 12 inches). Digital output from the embedded microprocessor also tends to advantageously reduce electrical interference in wiring to the main processor. Embedded microprocessor output may also be combined with a voltage source line to further reduce the number of wires required, e.g., one wire for combined power and data output and one wire for ground (or alternatively, the use of a chassis ground). This may be accomplished, for example, by imparting a high frequency digital signal to the voltage source line or by modulating the current draw from the voltage source line. Such techniques are known to those of ordinary skill in the art.

In preferred embodiments of this invention, microprocessor 255 (FIGS. 3 and 5) includes processor-readable or computer-readable program code embodying logic, including instructions for calculating a precise angular position of the shaft 115 relative to the housing 110 from the received magnetic sensor measurements. While substantially any logic routines may be utilized, it will be appreciated that logic routines requiring minimal processing power (e.g., as described above with respect to Equation 1) are advantageous for downhole applications (particularly for small-diameter LWD, MWD, and directional drilling embodiments of the invention in which both electrical and electronic processing power are often severely limited).

While the above described exemplary embodiments pertain to rotary steerable tool embodiments including hydraulically actuated blades, it will be understood that the invention is not limited in this regard. The artisan of ordinary skill will readily recognize other downhole uses of angular position sensors in accordance with the present invention. For example, angular position sensors in accordance with this invention may be deployed in conventional and/or steerable drilling fluid (mud) motors and utilized to determine the angular position of drill string components (e.g., MWD or LWD sensors) deployed below the motor with respect to those deployed above the motor. In one exemplary embodiment, the angular position sensor may be disposed, for example, to measure the relative angular position between the rotor and stator in the mud motor.

Directional Formation Evaluation

Figure 10:
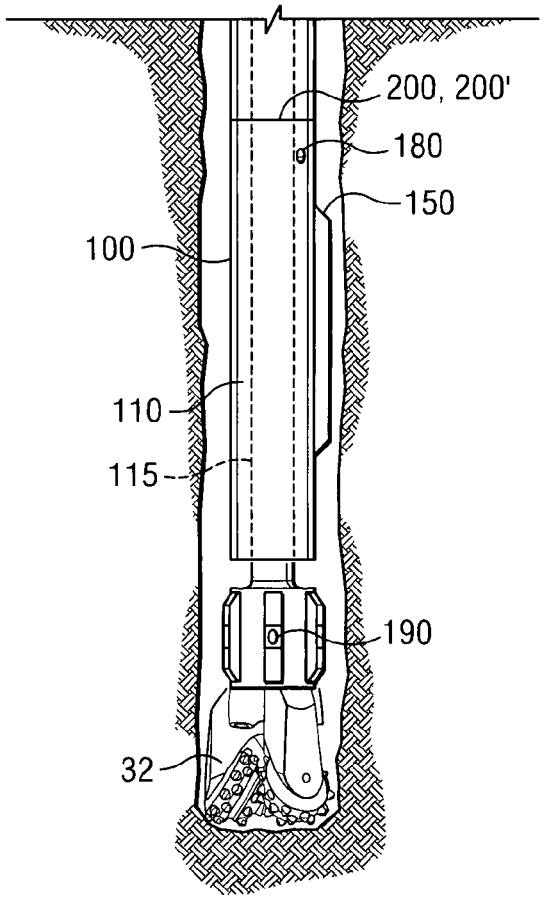
FIG. 10 depicts a bottom hole assembly suitable for use with directional (azimuthal) formation evaluation measurements in accordance with the present invention.

The angular position measurements described above may be advantageously utilized in combination with a formation evaluation sensor (an MWD/LWD sensor) to make near-bit, azimuthally sensitive formation evaluation measurements. Such measurements may in turn be used to form borehole images using known LWD imaging techniques. Turning now to FIG. 10, one exemplary embodiment of a BHA suitable for making direction formation evaluation (FE) measurements in accordance with exemplary embodiments of the present invention is illustrated. In FIG. 10, the BHA includes a drill bit assembly 32 coupled with a steering tool 100. Steering tool 100 includes a tri-axial accelerometer set 180 deployed in housing 110 and an angular sensor 200, 200' disposed to measure the angular position between rotating shaft 115 and housing 110. In the exemplary embodiment shown, steering tool 100 further includes one or more formation evaluation sensors 190 deployed near the drill bit 120 (e.g., in a near-bit stabilizer or other near-bit sub). Formation evaluation sensor 190 may include substantially any downhole LWD or MWD sensor(s) for measuring borehole and/or formation properties, for example, including a natural gamma ray sensor, a neutron sensor, a density sensor, a resistivity sensor, a formation pressure sensor, an annular pressure sensor, an ultrasonic sensor, an audio-frequency acoustic sensor, a borehole caliper sensor (with or without physical contact), and the like. The invention is not limited in these regards.

In the exemplary embodiment shown on FIG. 10, formation evaluation sensor(s) 190 are rotationally coupled with the drill string and typically rotate about the borehole during drilling. Accelerometer set 180 and angular position sensor 200, 200' may be used in combination to determine the tool face (azimuthal position) of the formation evaluation sensor (s) during drilling. During drilling, the angular position of the shaft 115 in the housing typically varies in time (due to the rotation of the shaft in the substantially non-rotating housing 110). At substantially any instant in time, a directional formation evaluation measurement may be made. At substantially the same instant in time the angular position of the shaft with respect to the housing (or the housing with respect to the shaft) may be measured using angular position sensor 200, 200', for example as described above with respect to FIGS. 3-7B, and the tool face of the housing 110 may be determined via accelerometer measurements as is known to those of ordinary skill in the art. The toolface of the formation evaluation sensor(s) 190 may then be determined, for example, via subtracting (or adding) the angular position measurement from the toolface of the housing 110. The toolface of the housing 110 may be computed substantially any known surveying sensor arrangement, e.g., including accelerometers, magnetometers, and gyros, however, accelerometer deployments are typically preferred low in the BHA. Moreover, as is also known to those of ordinary skill in the art, the toolface measurement sensors are not limited to tri-axial arrangements. The above described toolface measurements may be utilized in geo-steering applications and/or to form borehole images using techniques known to those of skill in the art.

In the exemplary method embodiment described above, angular position measurements may be advantageously obtained, for example, at approximately 10 millisecond intervals. For a drill collar rotating at 120 rpm, toolface angles may be determined 50 times per revolution (i.e., at approximately 7 degree intervals assuming a uniform rotation rate). It will be understood that the invention is expressly not limited in this regard, since angular position measurements may be made at substantially any suitable time interval. Hall-Effect sensors are known to be capable of achieving high frequency magnetic field measurements and are easily capable of obtaining magnetic field measurements at intervals of less than 10 milliseconds. It will be appreciated that in practice the advantages of making high frequency angular position measurements (e.g., to achieve better tool face resolution) may be offset by the challenge of storing and processing the large data sets generated by such high frequency measurements. Nevertheless, as state above, this invention is not limited to any particular magnetic field measurement frequency or to any particular time intervals.

As described above, the invention is also not limited to steering tool or rotary steerable embodiments. Rather, directional formation evaluation measurements may be made using substantially any suitable BHA configuration in which one portion of the BHA rotates about a longitudinal axis with respect to another portion of the BHA. For example, a near-bit formation evaluation sensor may be deployed between a drill bit and conventional and/or steerable mud motor or alternatively in the bit. Angular position measurements and accelerometer measurements may then be utilized, as described above, to calculate the toolface of the formation evaluation sensor.

Relative Rotation Rate Measurement

Exemplary angular position sensor embodiments in accordance with this invention may also be advantageously utilized to make average and differential relative rotation rate measurements, for example, between shaft 115 and housing 110 (FIGS. 3 and 5). For example, the change in angular position as a function of time may be used to calculate a relative rotation rate as follows $$RPM = \frac{\Delta P}{6 \cdot \Delta t} \qquad \text{Equation 2}$$

where RPM represents the relative rotation rate of the shaft 115 in revolutions per minute, ΔP represents the change in angular position between the shaft 115 and the housing 110 in units of degrees over some time interval Δt in seconds. Thus, according to Equation 2, a change in angular position of about 10 degrees in a 10 millisecond time interval indicates a rotation rate of about 167 rpm. Equation 2 may be advantageously utilized to determine rotation rates in either rotational direction (either clockwise or counterclockwise). Equation 2 may also be utilized to determine both instantaneous (differential) and average rotation rates. To determine an instantaneous rotation rate, time interval Δt is typically less than 1 second (e.g., 10 milliseconds as described above). To determine an average rotation rates, time interval Δt is typically greater than 1 second.

In exemplary steering tool embodiments, measurement of the relative rotation rate between the shaft and the housing may be advantageously utilized. For example, average rotation rate measurements may be utilized in decoding transmitted tool commands as is disclosed in commonly-assigned, co-pending U.S. patent application Ser. Nos. 10/882,789 (U.S. Patent Application Publication No. 2005/0001737 and U.S. Pat. No. 7,245,229) and 11/062,299 (U.S. Patent Application Publication No. 2006/0185900 and U.S. Pat. No. 7,222,681). Instantaneous (differential) rotation rate measurements may be further utilized to detect and quantify torsional vibration (stick-slip) of the drill string during drilling as is disclosed in commonly-assigned, co-pending U.S. patent application Ser. No. 11/454,019 (now U.S. Pat. No. 7,571,643).

Control Method for a Steering Tool

Angular position sensors 200, 200' may also be advantageously utilized to control a steering tool (i.e., to control the direction of drilling of a subterranean borehole). For example, in one exemplary embodiment, a BHA may include a measurement while drilling tool having a magnetic surveying device (such as a magnetometer) coupled with the drill string and deployed above a steering tool (both of which are deployed above a drill bit). In such an embodiment, the magnetic surveying device may be utilized to measure magnetic tool face angles of the drill string. A high frequency magnetic surveying device, such as disclosed in co-pending, commonly assigned U.S. Patent Application Publication No. 2007/0030007 (U.S. Pat. No. 7,414,405) may likewise be utilized to determine the magnetic tool face of the drill string. The angular position sensor 200, 200' may be simultaneously utilized to measure the corresponding angular position of the steering tool housing with respect to the drill string as described above. The combination of the magnetic tool face measurements of the drill string and the angular position measurements may be utilized (as described above) to calculate the magnetic toolface of the housing (e.g., by subtracting the angular position from the measured toolface). A magnetic tool face of the housing may then be utilized to control the drilling course of a directional drilling device (such as a rotary steerable tool) as is known to those of ordinary skill in the drilling arts. Such a control method may be particularly advantageous for small diameter tools since it obviates the need to have a dedicated tool face sensor in the steering tool housing.

The above described steering control method may also be advantageously utilized when kicking off from a vertical section of a borehole. As is known to those of ordinary skill in the art, it is generally not possible to determine a gravity toolface in a vertical section using conventional sensor arrangements. Moreover, magnetic toolface measurements are typically unreliable near steering tools or mud motors due to magnetic interference from magnetized tool components. Thus, in operations in which the angular position between housing 110 and shaft 115 is unknown, it is generally not possible to determine an appropriate kickoff direction. In such operations, the kickoff direction is often selected randomly and the well path corrected to plan after drilling about a 50-100 foot section of build. While this approach is serviceable, it also wastes valuable rig time and results a borehole having undesirable tortuosity.

The use of an angular position sensor in accordance with this invention advantageously enables a borehole to be kicked off from vertical in the proper direction. For example, the angular position between housing 110 and shaft 115 may be measured as described above. A magnetic toolface may also be measured at an MWD tool, which is typically rotationally coupled with the drill string and deployed above the steering tool 100. Therefore, a magnetic toolface of the housing 110 may be calculated from the angular position and magnetic toolface measurements (e.g., by subtracting the measured angular position from the measured magnetic toolface). The borehole may then be kicked off at the appropriate direction with respect to magnetic north (i.e., at the predetermined borehole azimuth).

It will be appreciated that the steering tool control methods described herein are not limited to the exemplary angular position sensor embodiments described above. It will be understood that such steering tool control methods may be utilized with substantially any steering tool configuration employing any suitable angular position sensor.

Although the present invention and its advantages have been described in detail, it should be understood that various changes, substitutions and alternations may be made herein without departing from the spirit and scope of the invention as defined by the appended claims.

I claim:

1. A downhole tool comprising:

first and second members disposed to rotate about a common axis with respect to one another;

first and second circumferentially spaced magnets deployed on the first member the first and second magnets being configured to emit a magnetic field having a radial component that varies in strength substantially linearly with an angular position about the second member for a range of at least 30 degrees in angular position;

a plurality of circumferentially spaced magnetic field sensors deployed on the second member, at least one of the magnetic field sensors in sensory range of magnetic flux emanating from at least one of the magnets; and a controller disposed to calculate an angular position of the first member with respect to the second member from magnetic flux measurements at the magnetic field sensors.

2. The downhole tool of claim 1, wherein the downhole tool is selected from the group consisting of directional drilling tools, rotary steerable tools, and drilling motors.

3. The downhole tool of claim 1, wherein the magnetic field sensors are deployed such that an axis of sensitivity of each of the sensors is substantially parallel with a radial direction.

4. The downhole tool of claim 1, comprising from about 5 to about 16 magnetic field sensors.

5. The downhole tool of claim 1, wherein the magnetic field sensors are selected from the group consisting of Hall-Effect sensors, magnetoresistive sensors, magnetometers, and reed switches.

6. The downhole tool of claim 1, wherein the plurality of magnetic field sensors and the controller are deployed on a circumferential array, the array being deployed in a ring shaped pressure resistant housing deployed on the second member.

7. The downhole tool of claim 1, wherein the magnetic field sensors are spaced equi-angularly about the circumference of the second member.

8. The downhole tool of claim 1, wherein the first and second magnets comprise cylindrical magnets, the first magnet having a magnetic north pole facing radially outward and the second magnet having a magnetic south pole facing radially outward.

9. The downhole tool of claim 1, wherein the first and second magnets are circumferentially spaced by an angle in the range from about 30 to about 180 degrees.

10. The downhole tool of claim 1, wherein the first and second magnets comprise arc-shaped magnets, the first magnet having a magnetic north pole on an outer surface thereof and a magnetic south pole an inner surface thereof, the second magnet having a magnetic south pole on an outer surface thereof and a magnetic north pole on an inner surface thereof.

11. The downhole tool of claim 1, wherein the controller is configured to calculate the angular position by calculating the circumferential location of a magnetic flux null.

12. The downhole tool of claim 11, wherein the controller calculates the circumferential location of the magnetic flux null by processing first and second magnetic flux measurements made at adjacent ones of the magnetic field sensors according to the equation:

$$P = L\left(x + \frac{A}{A+B}\right)$$

wherein P represents the location of the magnetic flux null, L represents an angular interval between said adjacent magnetic field sensors, A and B represent absolute values of the first and second magnetic flux measurements, and x represents a counting variable having an integer value representing the magnetic field sensor used to measure the first magnetic flux measurement.

13. A downhole tool comprising:

a shaft deployed to rotate substantially freely in a housing;

first and second arc-shaped magnets circumferentially spaced on the shaft, the first and second magnets being tapered, having a thin end and a thick end, such that a radial thickness of the magnets increases from the thin end to the thick end, the first magnet having a magnetic north pole on an outer surface and a magnetic south pole an inner surface thereof, the second magnet having a magnetic south pole on an outer surface and a magnetic north pole on an inner surface thereof;

a plurality of circumferentially spaced magnetic field sensors deployed in the housing, at least one of the magnetic field sensors in sensory range of magnetic flux emanating from at least one of the magnets; and a controller deployed in the housing and disposed to determine a relative angular position between the housing and the shaft from magnetic flux measurements made by the magnetic field sensors.

14. The downhole tool of claim 13 comprising a steering tool including at least one blade disposed to extend radially outward from the housing into contact with a borehole wall.

15. The downhole tool of claim 13, wherein the thick end has a thickness at least four times a thickness of the thin end.

16. The downhole tool of claim 13, wherein the thin end of the first magnet is proximate to the thin end of the second magnet.

17. The downhole tool of claim 13, wherein the first and second magnets each subtend a circular angle greater than an angular spacing between adjacent ones of the magnetic field sensors.

18. The downhole tool of claim 13, wherein the first and second magnets are configured to emit a magnetic field having a radial component that varies in strength substantially linearly with an angular position about the housing for a range of at least 30 degrees in angular position.

19. The downhole tool of claim 13, wherein the shaft and the housing are fabricated from at least one magnetic material.

20. The downhole tool of claim 13, comprising from about 5 to about 16 magnetic field sensors deployed equi-angularly about the circumference of the housing.

21. The downhole tool of claim 13, wherein the plurality of magnetic field sensors and the controller are deployed on a circumferential array, the array being deployed in a ring shaped, pressure resistant housing, the pressure resistant housing being deployed in the steering tool housing.

22. The downhole tool of claim 13, wherein the controller is configured to calculate the angular position by calculating a circumferential location of a magnetic flux null by processing first and second magnetic flux measurements made at adjacent ones of the magnetic field sensors according to the equation:

$$P = L\left(x + \frac{A}{A+B}\right)$$

wherein P represents the location of the magnetic flux null, L represents an angular interval between said adjacent magnetic field sensors, A and B represent absolute values of the first and second magnetic flux measurements, and x represents a counting variable having an integer value representing the magnetic field sensor used to measure the first magnetic flux measurement.

23. A method for determining a relative angular position between first and second members of a downhole tool, the method comprising:

(a) deploying a downhole tool in a borehole, the downhole tool including first and second members disposed to rotate about a common axis with respect to one another, first and second circumferentially spaced magnets deployed on the first member, a plurality of circumferentially spaced magnetic field sensors deployed on the second member wherein the first and second magnets are configured to emit a magnetic field having a radial component that varies in strength substantially linearly with an angular position about the second member for a range of at least 30 degrees in angular position;

(b) causing each of the magnetic field sensors to measure a magnetic flux; and (c) processing the magnetic flux measurements to calculate the relative angular position between the first and second members.

24. The method of claim 23, wherein (c) further comprises calculating a circumferential location of a magnetic flux null by processing first and second magnetic flux measurements made at adjacent ones of the magnetic field sensors according to the equation:

$$P = L\left(x + \frac{A}{A+B}\right)$$

wherein P represents the location of the magnetic flux null, L represents an angular interval between said adjacent magnetic field sensors, A and B represent absolute values of the first and second magnetic flux measurements, and x represents a counting variable having an integer value representing the magnetic field sensor used to measure the first magnetic flux measurement.

25. The method of claim 23, wherein the first and second magnets comprise tapered, arc-shaped magnets, having a thin end and a thick end, such that a radial thickness of the magnets increases from the thin end to the thick end, the first magnet having a magnetic north pole on an outer surface thereof and a magnetic south pole an inner surface thereof, the second magnet having a magnetic south pole on an outer surface thereof and a magnetic north pole on an inner surface thereof.

26. The method of claim 23, further comprising:

(d) repeating steps (b) and (c) at a time interval in the range from about 10 to about 100 milliseconds.

27. The method of claim 23, further comprising:

(d) repeating steps (b) and (c); and (e) processing the angular position measurements calculated in (c) and (d) and a time interval between said angular position measurements to calculate a relative rotation rate between the first and second members.

28. A downhole tool comprising:

first and second members disposed to rotate about a common axis with respect to one another;

first and second arc-shaped magnets circumferentially spaced on the shaft, the first magnet having a magnetic north pole on an outer surface and a magnetic south pole an inner surface thereof, the second magnet having a magnetic south pole on an outer surface and a magnetic north pole on an inner surface thereof;

first and second tapered, arc-shaped magnetic lenses deployed radially between the first and second magnets and selected ones of the magnetic field sensors, the magnetic lenses being fabricated from a magnetic material;

a plurality of circumferentially spaced magnetic field sensors deployed on the second member, at least one of the magnetic field sensors in sensory range of magnetic flux emanating from at least one of the magnets; and a controller disposed to calculate an angular position of the first member with respect to the second member from magnetic flux measurements at the magnetic field sensors.

29. A downhole tool comprising:

first and second members disposed to rotate about a common axis with respect to one another;

first and second circumferentially spaced sets of discrete magnets deployed on the first member, each set including a plurality of discrete magnets circumferentially spaced about a unique circumferential portion of the first member, a magnetic strength of the discrete magnets increasing from one end of each set to an opposing end;

a plurality of circumferentially spaced magnetic field sensors deployed on the second member, at least one of the magnetic field sensors in sensory range of magnetic flux emanating from at least one of the magnets; and a controller disposed to calculate an angular position of the first member with respect to the second member from magnetic flux measurements at the magnetic field sensors.

* * * * *